US005972854A

United States Patent [19]

Ichihashi et al.

[11] Patent Number: 5,972,854

[45] Date of Patent: Oct. 26, 1999

[54] LUBRICATING OIL COMPOSITION FOR AUTOMATIC TRANSMISSION

[75] Inventors: Toshihiko Ichihashi; Hideo Igarashi; Junichi Deshimaru; Toshiki Ikeda, all of Ichihara, Japan

[73] Assignee: Idemitsu Kosan Co., Ltd., Tokyo, Japan

[21] Appl. No.: 08/870,300

[22] Filed: Jun. 6, 1997

[30] Foreign Application Priority Data

Jun. 12, 1996 [JP] Japan ..... 8-150684

[51] Int. Cl.[6] ..... C10M 133/00; C10M 133/16; C10M 135/12; C10M 137/04

[52] U.S. Cl. ..... 508/433; 508/436; 508/438; 508/509; 508/545; 508/551; 508/563

[58] Field of Search ..... 508/436, 551, 508/421, 433, 438, 545, 509, 563, 564

[56] References Cited

U.S. PATENT DOCUMENTS

| | | | |
|---|---|---|---|
| 2,682,508 | 6/1954 | Godfrey | 508/436 |
| 3,909,448 | 9/1975 | McGuigan et al. | 252/402 |
| 4,049,561 | 9/1977 | Hotten | 508/436 |
| 4,062,785 | 12/1977 | Nibert | 508/551 |
| 4,280,916 | 7/1981 | Richards | 508/551 |
| 4,743,389 | 5/1988 | Braid et al. | 508/551 |
| 5,064,549 | 11/1991 | Dasai | 508/436 |
| 5,536,423 | 7/1996 | Miyagawa et al. | 508/436 |
| 5,595,964 | 1/1997 | Bardasz | 508/423 |

FOREIGN PATENT DOCUMENTS

| | | |
|---|---|---|
| 0 286 996 | 10/1988 | European Pat. Off. . |
| 0 630 960 | 12/1994 | European Pat. Off. . |
| 0 678 569 | 10/1995 | European Pat. Off. . |
| WO 97/14772 | 4/1997 | WIPO . |

*Primary Examiner*—Cephia D. Toomer
*Attorney, Agent, or Firm*—Oblon, Spivak, McClelland, Maier & Neustadt, P.C.

[57] ABSTRACT

Disclosed is a lubricating oil composition for automatic transmissions, which comprises a base oil and additives of (A) a sulfur-containing antioxidant or an amine-type antioxidant, (B) a phosphate or its amine salt, and (C) a reaction product of a carboxylic acid and an amine. The composition has an excellent ability to prevent the brake lining of the clutch of automatic transmissions from shuddering, and can maintain the shudder-preventing ability for a long period of time.

7 Claims, No Drawings

LUBRICATING OIL COMPOSITION FOR AUTOMATIC TRANSMISSION

BACKGROUND OF THE INVENTION

1. Field of the Invention

The present invention relates to a lubricating oil composition for automatic transmissions, and, more precisely, to that having an excellent ability to prevent the brake lining of the clutch of automatic transmissions from shuddering, and capable of maintaining the shudder-preventing ability for a long period of time.

2. Description of the Related Art

Automatic transmissions (AT), especially those equipped with a continuous slip mechanism are required to have the ability to prevent shudders that may occur in the clutch of AT. Cars using a conventional automatic transmission fluid (ATF) greatly shudder. Various attempts have been made to prevent cars from shuddering. For example, Japanese Patent Application Laid-Open No. 7-305082 discloses a lubricating oil composition for automatic transmissions, which comprises a base oil and additives of (1) zinc dithiophosphate and/or basic zinc dithiophosphate, (2) at least one compound selected from the group consisting of phosphates, acid phosphates and phosphites and (3) an organic friction regulator having a specific bond and/or a functional group as introduced into the molecule. This composition is effective in preventing initial shudders but is defective in that, while it is used for a long period of time, zinc dithiophosphate therein adheres to the surface of a wet clutch to thereby greatly shorten the shudder-preventing life of the composition, resulting in that the composition could no more maintain its original properties. Japanese Patent Application Laid-Open No. 63-254196 discloses the addition of a friction regulator of any of phosphates, fatty acid esters and fatty acid amides to ATF, which, however, is not satisfactory for preventing initial shudders.

Given the situation, the present invention is to provide a lubricating oil composition for automatic transmissions which has an excellent ability to prevent the brake lining of the clutch of automatic transmissions from shuddering, and can maintain the shudder-preventing ability for a long period of time.

SUMMARY OF THE INVENTION

We, the present inventors have assiduously studied and, as a result, have found that the object of the present invention can be effectively attained by adding a specific antioxidant, a phosphate or its amine salt, and a reaction product of a carboxylic acid and an amine to a base oil. On the basis of this finding, we have completed the present invention.

Specifically, the present invention is to provide a lubricating oil composition for automatic transmissions, which comprises a base oil and additives of (A) a sulfur-containing antioxidant or an amine-type antioxidant, (B) a phosphate or its amine salt, and (C) a reaction product of a carboxylic acid and an amine.

DETAILED DESCRIPTION OF THE INVENTION

Now, the modes of carrying out the invention are described hereinunder.

The lubricating oil composition for automatic transmissions of the present invention comprises a mineral oil and/or a synthetic oil as the base oil. The mineral oil and the synthetic oil are not specifically defined, but may be any ordinary ones that are generally used as the base oil of ordinary transmission fluids. However, preferred are those having a dynamic viscosity at 100° C. of from 1 to 20 $mm^2/s$, more preferably from 2 to 10 $mm^2/s$. If the base oil has a too high dynamic viscosity, its low-temperature viscosity is unfavorably low; but, on the contrary, if its dynamic viscosity is too low, such is also unfavorable since the base oil having such a too low dynamic viscosity causes the increase of the wear in the slide members such as gear bearings and clutches of automatic transmissions. The pour point of the base oil, which is the index for its low-temperature fluidity, is not specifically defined, but is desirably not higher than −10° C.

Various types of such mineral oil and synthetic oil are known, and any desirable ones may be selectively used in accordance with the object. The mineral oil includes, for example, paraffinic mineral oils, naphthenic mineral oils and intermediate base mineral oils. As specific examples, referred to are light neutral oils, medium-gravity neutral oils, heavy neutral oils and bright stocks to be prepared through solvent purification or hydrogenating purification.

On the other hand, the synthetic oil includes, for example, poly-α-olefins, α-olefin copolymers, polybutenes, alkylbenzenes, polyol esters, dibasic acid esters, polyoxyalkylene glycols, polyoxyalkylene glycol esters, polyoxyalkylene glycol ethers, and silicone oils.

These base oils can be used singly or as combined. Combinations of mineral oils and synthetic oils are also employable.

Now, the additives (A) to (C) to the base oil are referred to hereinunder.

Component (A)

The sulfur-containing antioxidant may be any and every antioxidant containing sulfur, for example, including dialkyl thiodipropionates such as dilauryl thiodipropionate and distearyl thiodipropionate, dialkyldithiocarbamic acid derivatives (excluding metal salts), bis(3,5-di-t-butyl-4-hydroxybenzyl)sulfide, mercaptobenzothiazole, reaction products of phosphorus pentoxide and olefins, and dicetyl sulfide. Of these, preferred are dialkyl thiodipropionates such as dilauryl thiodipropionate and distearyl thiodipropionate.

The amine-type antioxidant includes, for example, monoalkyldiphenylamines such as monooctyldiphenylamine and monononyldiphenylamine; dialkyldiphenylamines such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine; polyalkyldiphenylamines such as tetrabutyldiphenylamine, tetrahexyldiphenylamine, tetraoctyldiphenylamine and tetranonyldiphenylamine; and naphthylamines such as α-naphthylamine, phenyl-α-naphthylamine, butylphenyl-α-naphthylamine, pentylphenyl-α-naphthylamine, hexylphenyl-α-naphthylamine, heptylphenyl-α-naphthylamine, octylphenyl-α-naphthylamine and nonylphenyl-α-naphthylamine. Of these, preferred are dialkyldiphenylamines.

The sulfur-containing antioxidant and the amine-type antioxidant are added to the base oil in an amount of from 0.01 to 5% by weight, preferably from 0.03 to 3% by weight, relative to the total weight of the composition.

Component (B)

Phosphates for use in the present invention include phosphates, acid phosphates, phosphites and acid phosphites of general formulae (I) to (V):

(I)

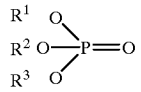

(II)

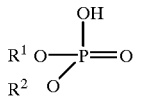

(III)

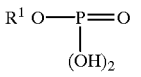

(IV)

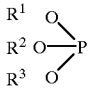

(V)

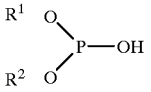

In these general formulae (I) to (V), $R^1$ to $R^3$ each represents an alkyl, alkenyl, alkylaryl or arylalkyl group having from 4 to 30 carbon atoms; and these $R^1$ to $R^3$ may be the same or different.

The phosphates include triaryl phosphates, trialkyl phosphates, trialkylaryl phosphates, triarylalkyl phosphates and trialkenyl phosphates. As specific examples of these, referred to are triphenyl phosphate, tricresyl phosphate, benzyldiphenyl phosphate, ethyldiphenyl phosphate, tributyl phosphate, ethyldibutyl phosphate, cresyldiphenyl phosphate, dicresylphenyl phosphate, ethylphenyldiphenyl phosphate, diethylphenylphenyl phosphate, propylphenyldiphenyl phosphate, dipropylphenylphenyl phosphate, triethylphenyl phosphate, tripropylphenyl phosphate, butylphenyldiphenyl phosphate, dibutylphenylphenyl phosphate, tributylphenyl phosphate, trihexyl phosphate, tri(2-ethylhexyl) phosphate, tridecyl phosphate, trilauryl phosphate, trimyristyl phosphate, tripalmityl phosphate, tristearyl phosphate, and trioleyl phosphate.

The acid phosphates include, for example, 2-ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate, and isostearyl acid phosphate.

The phosphites include, for example, triethyl phosphite, tributyl phosphite, triphenyl phosphite, tricresyl phosphite, tri(nonylphenyl) phosphite, tri(2-ethylhexyl) phosphite, tridecyl phosphite, trilauryl phosphite, triisooctyl phosphite, diphenylisodecyl phosphite, tristearyl phosphite, and trioleyl phosphite.

The acid phosphites include, for example, dibutyl hydrogenphosphite, dilauryl hydrogenphosphite, dioleyl hydrogenphosphite, distearyl hydrogenphosphite, and diphenyl hydrogenphosphite.

Of the above-mentioned phosphates, preferred are oleyl acid phosphate and tricresyl phosphate.

Amines that form amine salts with such phosphates include, for example, mono-substituted amines, di-substituted amines and tri-substituted amines of a general formula (VI):

$$R_nNH_{3-n} \quad \text{(VI)}$$

wherein R represents an alkyl or alkenyl group having from 3 to 30 carbon atoms, an aryl or arylalkyl group having from 6 to 30 carbon atoms, or a hydroxyalkyl group having from 2 to 30 carbon atoms; n represents 1, 2 or 3; and when the compound has a plurality of Rs, such plural Rs may be the same or different.

In general formula (VI), the alkyl or alkenyl group with from 3 to 30 carbon atoms to be represented by R may be linear, branched or cyclic.

Examples of the mono-substituted amines include butylamine, pentylamine, hexylamine, cyclohexylamine, octylamine, laurylamine, stearylamine, oleylamine and benzylamine; and those of the di-substituted amines include dibutylamine, dipentylamine, dihexylamine, dicyclohexylamine, dioctylamine, dilaurylamine, distearylamine, dioleylamine, dibenzylamine, stearyl monoethanolamine, decyl monoethanolamine, hexyl monopropanolamine, benzyl monoethanolamine, phenyl monoethanolamine, and tolyl monopropanolamine. Examples of tri-substituted amines include tributylamine, tripentylamine, trihexylamine, tricyclohexylamine, trioctylamine, trilaurylamine, tristearylamine, trioleylamine, tribenzylamine, dioleyl monoethanolamine, dilauryl monopropanolamine, dioctyl monoethanolamine, dihexyl monopropanolamine, dibutyl monopropanolamine, oleyl diethanolamine, stearyl dipropanolamine, lauryl diethanolamine, octyl dipropanolamine, butyl diethanolamine, benzyl diethanolamine, phenyl diethanolamine, tolyl dipropanolamine, xylyl diethanolamine, triethanolamine, and tripropanolamine.

Phosphates or their amine salts are added to the base oil in an amount of from 0.03 to 5% by weight, preferably from 0.1 to 4% by weight, relative to the total weight of the composition.

Component (C)

Carboxylic acids to be reacted with amines include, for example, aliphatic carboxylic acids, dicarboxylic acids (dibasic acids), and aromatic carboxylic acids. The aliphatic carboxylic acids have from 8 to 30 carbon atoms, and may be saturated or unsaturated, and linear or branched. Specific examples of the aliphatic carboxylic acids include pelargonic acid, lauric acid, tridecanoic acid, myristic acid, palmitic acid, stearic acid, isostearic acid, eicosanoic acid, behenic acid, triacontanoic acid, caproleic acid, undecylenic acid, oleic acid, linolenic acid, erucic acid, and linoleic acid. Specific examples of the dicarboxylic acids include octadecylsuccinic acid, octadecenylsuccinic acid, adipic acid, azelaic acid, and sebacic acid. One example of the aromatic carboxylic acids is salicylic acid.

On the other hand, the amines to be reacted with carboxylic acids include, for example, polyalkylenepolyamines such as diethylenetriamine, triethylenetetramine, tetraethylenepentamine, pentaethylenehexamine, hexaethyleneheptamine, heptaethyleneoctamine, dipropylenetriamine, tetrapropylenepentamine, and hexabutyleneheptamine; and alkanolamines such as monoethanolamine and diethanolamine.

Of these, preferred are a combination of isostearic acid and tetraethylenepentamine, and a combination of oleic acid and diethanolamine. The reaction products of carboxylic acids and amines are added to the base oil in an amount of from 0.01 to 5% by weight, preferably from 0.03 to 3% by weight, relative to the total weight of the composition.

The composition of the present invention can be obtained by adding the above-mentioned components (A) to (C) to a base oil. In order to improve its physical properties, in general, the lubricating oil composition of the invention may optionally contain a viscosity index improver, an ash-free dispersant, a detergent, an extreme-pressure agent, a defoaming agent, and a rust inhibitor.

Now, the present invention is described in more detail hereinunder with reference to the following examples, which, however, are not intended to restrict the scope of the invention.

Methods for Testing Properties of Samples Produced in Examples and Comparative Examples (1) Shudder-preventing Ability:

A ratio of $\mu_1/\mu_{50}$ was obtained, according to the method of testing properties of automatic transmission fluids (JASO M349-95), to evaluate the shudder-preventing ability of samples.

$\mu_1$: coefficient of friction at a sliding velocity of 1 rpm.

$\mu_{50}$: coefficient of friction at a sliding velocity of 50 rpm.

(2) Shudder-preventing Life:

According to JASO M349-95, samples were subjected to a durability test under the condition mentioned below, in which the frictional characteristics of each sample were measured every 8 hours. The time within which the ratio of $\mu_1/\mu_{50}$ reached 1 or more was measured to be the life time of each sample.

Oil temperature: 120° C.

Surface pressure: 1.00±0.05 MPa

Number of revolution: 200 rpm (3) Transmission Torque Capacity:

According to JASO M349-95, samples were subjected to a test for frictional characteristics, in which the coefficient of static friction ($\mu_s$) was obtained to evaluate the samples.

EXAMPLE 1

As the base oil used herein was a paraffinic mineral oil (having a dynamic viscosity at 100° C. of 5 $mm^2/s$), to which were added 0.5% by weight of dilauryl thiodipropionate as the component (A), 0.5% by weight of tricresyl phosphate as the component (B) and 0.5% by weight of isostearic acid tetraethylenepentamide as the component (C). In addition, further added thereto were 9.5% by weight of polymethacrylate (viscosity index improver), 2% by weight of polybutenylsuccinimide (ash-free dispersant), 2% by weight of calcium sulfonate (detergent), and 0.5% by weight of sulfurized oils and fats (extreme-pressure agent), the additives being 14% by weight in total. Thus was prepared a lubricating oil composition for automatic transmissions, which was subjected to the property tests mentioned above. The data obtained are shown in Table 1 below.

EXAMPLES 2 TO 6 AND COMPARATIVE EXAMPLES 1 TO 8

Various lubricating oil compositions for automatic transmissions were prepared in the same manner as in Example 1 except that the amount of the base oil, the components (A) to (C) and their amounts were varied to those as in Table 1. These were subjected to the property tests mentioned above. The data obtained are shown in Table 1.

TABLE 1-1

| | | | Example 1 | Example 2 | Example 3 |
|---|---|---|---|---|---|
| Composition wt. % | Base Oil | | 84.5 | 84.45 | 83.45 |
| | Component (A) | Dilauryl Thiodipropionate | 0.5 | 1.0 | 0.05 |
| | | Dioctyldiphenyiamine | — | — | — |
| | Component (B) | Tricresyl Phosphate | 0.5 | — | 1.0 |
| | | Dioleyl Acid Phosphate | — | 0.5 | — |
| | Component (C) | Isostearic Acid Tetraethylenepentamide | 0.5 | 0.05 | — |
| | | Oleic Acid Diethanoiamide | — | — | 1.5 |
| | Other Additives: viscosity index improver, extreme-pressure agent, etc. | | 14.0 | 14.0 | 14.0 |
| Shudder-preventing Ability | | | 0.85 | 0.86 | 0.82 |
| Shudder-preventing Life (hr) | | | 60 | 55 | 53 |
| Transmission Torque Capacity (as $\mu s$) | | | 0.13 | 0.14 | 0.12 |

TABLE 1-2

| | | | Comparative Example 1 | Comparative Example 2 | Comparative Example 3 |
|---|---|---|---|---|---|
| Composition wt. % | Base Oil | | 81.5 | 82.0 | 83.5 |
| | Component (A) | Dilauryl Thiodipropionate | — | 1.0 | 1.0 |
| | | Dioctyldiphenyiamine | — | — | — |
| | Component (B) | Tricresyl Phosphate | 3.0 | 3.0 | — |
| | | Dioleyl Acid Phosphate | — | — | — |
| | Component (C) | Isostearic Acid Tetraethylenepentamide | 1.5 | — | — |
| | | Oleic Acid Diethanoiamide | — | — | 1.5 |
| | Other Additives: viscosity index improver, extreme-pressure agent, etc. | | 14.0 | 14.0 | 14.0 |
| Shudder-preventing Ability | | | 0.98 | 1.10 | 0.96 |
| Shudder-preventing Life (hr) | | | 22 | 0 | 20 |
| Transmission Torque Capacity (as $\mu s$) | | | 0.12 | 0.14 | 0.10 |

TABLE 1-3

| | | | Comparative Example 4 | Comparative Example 5 | Example 4 |
|---|---|---|---|---|---|
| Composition wt. % | Base Oil | | 81.5 | 78.0 | 84.5 |
| | Component (A) | Dilauryl Thiodipropionate | 1.0 | — | — |
| | | Dioctyldiphenyiamine | — | — | 0.5 |
| | Component (B) | Tricresyl Phosphate | — | — | 0.5 |
| | | Dioleyl Acid Phosphate | — | 0.8 | — |
| | Component (C) | Isostearic Acid Tetraethylenepentamide | — | — | 0.5 |
| | | Oleic Acid Diethanoiamide | 3.5 | — | — |
| | Other Additives: viscosity index improver, extreme-pressure agent, etc. | | 14.0 | 14.0 | 14.0 |
| Shudder-preventing Ability | | | 0.88 | 0.75 | 0.84 |
| Shudder-preventing Life (hr) | | | 29 | 18 | 62 |
| Transmission Torque Capacity (as $\mu s$) | | | 0.07 | 0.05 | 0.13 |

TABLE 1-4

| | | | Example 5 | Example 6 | Comparative Example 6 |
|---|---|---|---|---|---|
| Composition wt. % | Base Oil | | 84.45 | 84.45 | 81.5 |
| | Component (A) | Dilauryl Thiodipropionate | — | — | — |
| | | Dioctyldiphenyiamine | 1.0 | 0.05 | — |
| | Component (B) | Tricresyl Phosphate | — | 1.0 | 3.0 |
| | | Dioleyl Acid Phosphate | 0.5 | — | — |
| | Component (C) | Isostearic Acid Tetraethylenepentamide | 0.05 | — | 1.5 |
| | | Oleic Acid Diethanoiamide | — | 1.5 | — |
| | Other Additives: viscosity index improver, extreme-pressure agent, etc. | | 14.0 | 14.0 | 14.0 |
| Shudder-preventing Ability | | | 0.85 | 0.83 | 0.98 |
| Shudder-preventing Life (hr) | | | 60 | 50 | 2 |
| Transmission Torque Capacity (as $\mu s$) | | | 0.14 | 0.12 | 0.12 |

TABLE 1-5

| | | | Comparative Example 7 | Comparative Example 8 |
|---|---|---|---|---|
| Composition wt. % | Base Oil | | 82.0 | 83.5 |
| | Component (A) | Dilauryl Thiodipropionate | — | — |
| | | Dioctyldiphenyiamine | 1.0 | 1.0 |
| | Component (B) | Tricresyl Phosphate | 3.0 | — |
| | | Dioleyl Acid Phosphate | — | — |
| | Component (C) | Isostearic Acid Tetraethylenepentamide | — | — |
| | | Oleic Acid Diethanoiamide | — | 1.5 |
| | Other Additives: viscosity index improver, extreme-pressure agent, etc. | | 14.0 | 14.0 |
| Shudder-preventing Ability | | | 1.15 | 0.89 |
| Shudder-preventing Life (hr) | | | 0 | 20 |
| Transmission Torque Capacity (as $\mu s$) | | | 0.15 | 0.09 |

From Examples and Comparative Examples, known are the following. Of the samples of Examples, the ratio, $\mu_1/\mu_{50}$ was from 0.82 to 0.86, which was smaller than 1. Thus, these samples have good shudder-preventing ability. Their shudder-preventing life as measured in the predetermined test was from 50 to 62 hours, which was two times or longer than that of the samples of Comparative Examples. Their transmission torque capacity was larger than 0.1, and the samples of Examples are excellent as automatic transmission fluids.

As opposed to these, the samples of Comparative Examples 1 and 6, though comprising the components (B) and (C) in predetermined amounts, had an extremely short shudder-preventing life and therefore could not attain the object of the invention. The samples of Comparative Examples 2 and 7, as not containing the component (C), could not have a satisfactory shudder-preventing ability; while those of Comparative Examples 3 and 8 not containing the component (B) had a short shudder-preventing life. The samples of Comparative Examples 4 and 5 comprised large amounts of the components (B) and (C) in order to have a prolonged shudder-preventing life. Though prolonged in some degree, their shudder-preventing life was still ½ or smaller than the life of the samples of Examples. In addition, as their transmission torque capacity was smaller than 0.1, the samples of Comparative Examples 4 and 5 are unfavorable as automatic transmission fluids. Even if the components (B) and (C) are merely increased in order to prolong the shudder-preventing life, such brings about the decrease in the torque capacity and the resulting compositions could not be put into practical use as automatic transmission fluids.

As has been mentioned and demonstrated in detail hereinabove, the lubricating oil composition for automatic transmissions of the present invention has an excellent shudder-preventing ability while maintaining the shudder-preventing ability for a long period of time, and has a high transmission torque capacity.

While the invention has been described in detail and with reference to specific embodiments thereof, it will be apparent to one skilled in the art that various changes and modifications can be made therein without departing from the spirit and scope thereof.

What is claimed is:

1. A lubricating oil composition for automatic transmissions, which comprises a base oil and an additive consisting essentially of (A) 0.05 to 1% of a sulfur-containing antioxidant selected from the group consisting of dialkyl thiodipropionates or an amine antioxidant selected from the group consisting of dialkyl diphenyl amines, (B) 0.5 to 1% of an organic phosphate or its amine salt selected from the group consisting of phosphate triesters and acid diesters, and (C) 0.05 to 0.5% of isostearic acid tetraethylenepentamide or 1.5% of oleic acid diethanolamide, all by weight relative to the total weight of the composition.

2. The lubricating oil composition for automatic transmissions as claimed in claim 1, wherein component (A) is dilauryl thiodipropionate present in an amount of 0.5%, component (B) is tricresyl phosphate in an amount of 0.5%, and component (C) is isostearic acid tetraethylenepentamide in an amount of 0.5%.

3. The lubricating oil composition for automatic transmissions as claimed in claim 1, wherein component (A) is dilauryl thiodipropionate present in an amount of 1.0%, component (B) is dioleyl acid phosphate in an amount of 0.5%, and component (C) is isostearic acid tetraethylenepentamide in an amount of 0.05%.

4. The lubricating oil composition for automatic transmissions as claimed in claim 1, wherein component (A) is dilauryl thiodipropionate present in an amount of 0.05%, component (B) is tricresyl phosphate in an amount of 1.0%, and component (C) is oleic acid diethanolamide in an amount of 1.5%.

5. The lubricating oil composition for automatic transmissions as claimed in claim 1, wherein component (A) is dioctyldiphenylamine present in an amount of 0.5%, component (B) is tricresyl phosphate in an amount of 0.5%, and component (C) is isostearic acid tetraethylenepentamide in an amount of 0.5%.

6. The lubricating oil composition for automatic transmissions as claimed in claim 1, wherein component (A) is dioctyldiphenylamine present in an amount of 1.0%, component (B) is dioleyl acid phosphate in an amount of 0.5%, and component (C) is isostearic acid tetraethylenepentamide in an amount of 0.05%.

7. The lubricating oil composition for automatic transmissions as claimed in claim 1, wherein component (A) is dioctyldiphenylamine present in an amount of 0.05%, component (B) is tricresyl phosphate in an amount of 1.0%, and component (C) is oleic acid diethanolamide in an amount of 1.5%.

* * * * *